US008033858B1

(12) United States Patent
Chen

(10) Patent No.: US 8,033,858 B1
(45) Date of Patent: Oct. 11, 2011

(54) LAMP HOLDER WITH A FIXING ELEMENT FIXED TO A CONTACT PLATE ON ONE SIDE OF AN INSULATING BASE AND TO A WIRING ELEMENT ON OTHER SIDE OF THE BASE

(75) Inventor: Chia-Cheng Chen, Taoyuan (TW)

(73) Assignee: Sun-Lite Sockets Industry Inc., Taoyuan (TW)

( * ) Notice: Subject to any disclaimer, the term of this patent is extended or adjusted under 35 U.S.C. 154(b) by 0 days.

(21) Appl. No.: 13/004,966

(22) Filed: Jan. 12, 2011

(51) Int. Cl.
*H01R 4/26* (2006.01)

(52) U.S. Cl. ..... 439/419

(58) Field of Classification Search ..... 439/419, 439/257, 699.2, 459, 660, 602; 362/226, 362/205, 186, 427; 200/329, 457
See application file for complete search history.

(56) References Cited

U.S. PATENT DOCUMENTS

| | | | | |
|---|---|---|---|---|
| 2,739,291 | A * | 3/1956 | Frankel | 439/417 |
| 5,439,389 | A * | 8/1995 | Cheng et al. | 439/419 |
| 6,079,997 | A * | 6/2000 | Lu | 439/206 |
| 6,692,308 | B2 * | 2/2004 | Henrici et al. | 439/699.2 |
| 6,768,072 | B1 * | 7/2004 | Yang | 200/329 |
| 7,294,006 | B1 * | 11/2007 | Chen et al. | 439/257 |
| 7,654,854 | B1 * | 2/2010 | Yang | 439/419 |
| 2006/0039156 | A1 * | 2/2006 | Chen | 362/427 |

* cited by examiner

*Primary Examiner* — Chandrika Prasad
(74) *Attorney, Agent, or Firm* — Bacon & Thomas, PLLC

(57) ABSTRACT

A lamp holder includes a contact plate having an end in a curved shape, and the other end fixed onto a side of an insulating base by an end of a first fixing element, such that a predetermined distance is formed between the end of the contact plate and the insulating base. The first fixing element is passed through the insulating base, and the other end thereof is outside the other side of the insulating base for coupling an anode wiring element. A thread is formed inside a contact socket, and an extended portion is extended from the bottom side of the contact socket and fixed onto the insulating base by a second fixing element, and the second fixing element is passed through the insulating base, and the other end thereof is outside the other side of the insulating base for coupling a cathode wiring element.

7 Claims, 5 Drawing Sheets

LAMP HOLDER WITH A FIXING ELEMENT FIXED TO A CONTACT PLATE ON ONE SIDE OF AN INSULATING BASE AND TO A WIRING ELEMENT ON OTHER SIDE OF THE BASE

FIELD OF THE INVENTION

The present invention relates to a lamp holder, in particular to a lamp holder using a first fixing element for fixing a contact plate and an anode wiring element onto both sides of an insulating base respectively and a second fixing element for fixing a contact socket and a cathode wiring element onto both sides of the insulating base respectively to achieve the effects of simplifying the overall structure and saving the material cost of the lamp holder.

BACKGROUND OF THE INVENTION

Since light bulb has the advantage of an easy installation, incandescent bulb is generally used for nighttime and indoor illuminations. However, the incandescent bulb has the disadvantages of high consumption of electric power and short lifespan (with an average lifespan of approximately 1,000 hours), so that many users have started using the power-saving fluorescent bulb a decade ago to comply with the environmental protection and energy saving requirements. The so-called fluorescent bulb refers to a whole illumination device that includes a fluorescent lamp and a stabilizer and provides an average lifespan of approximately 6,000 hours. Besides the incandescent bulb and fluorescent bulb, many lamp manufacturers start producing light emitting diode (LED) bulb as the LED technology advances. Regardless of the incandescent bulb, fluorescent bulb or LED bulb, the interfaces for the lamp heads of these bulbs are the same, and these lamp heads of the same size have an identical shape, so that the three different types of bulbs can be installed interchangeably to lamp holders of different specifications. At present, one of the common specifications of lamp holders is E26 which stands for the diameter of a screw bulb installable onto a contact socket equal to 26 mm. In addition to the E26 specifications, there are specifications for smaller lamp holders such as E12 and E14.

With reference to FIG. 1 for a perspective exploded view of a conventional lamp holder 1, the lamp holder 1 comprises an insulating base 10, a contact plate 11, an anode plate 12, a contact socket 13 and a cathode plate 14, and the insulating base 10 includes a first penetrating hole 100 formed on and penetrated through the insulating base 10, and the contact plate 11 and the anode plate 12 are riveted and fixed onto the insulating base 10 by a rivet 15*a*, such that the contact plate 11 and the anode plate 12 are attached closely with one another, and the anode plate 12 includes an anode wiring portion 120 bent from the anode plate 12, and a screw hole 121 formed on and penetrated through the anode wiring portion 120 and provided for screwing a screw 122 thereon to clamp and fix an anode power cord (not shown in the figure) onto the anode plate 12, such that the contact plate 11 can be electrically coupled to the anode power cord through the anode plate 12. In addition, the contact socket 13 includes two extended portions 130 extended radially inward from the bottom of the contact socket 13, and the cathode plate 14 is disposed at the top side of the extended portion 130, and the contact socket 13 and the cathode plate 14 are fixed onto the insulating base 10 through the two rivets 15*b*, 15*c*. In other words, the rivets 15*b*, 15*c* are passed through two through holes 140*a*, 140*b* of the cathode plate 14 respectively and the extended portion 130 of the contact socket 13, and then fixed onto the insulating base 10.

The cathode plate 14 includes a cathode wiring portion 140 bent from the cathode plate 14, and a screw hole 141 formed on and penetrated through the cathode wiring portion 140 and provided for screwing a screw 142 thereon to clamp and fix a cathode power cord (not shown in the figure) onto the cathode plate 14, such that the contact socket 13 can be electrically coupled to the cathode power cord through the cathode plate 14, and when the bulb is secured onto the contact socket 13, the bulb is electrically coupled to the cathode power cord through the contact socket 13 and the cathode plate 14. With reference to FIG. 2, the contact plate 11 includes a contact portion 110 bent towards the insulating base 10, such that an upper lateral side of the contact portion 110 can be contacted with an electrode of the bulb. Since a distance is maintained between the contact portion 110 and the insulating base 10, the contact portion 110 can have a slight elasticity to be attached closely onto the electrode of the bulb, and the electrode of the bulb can be electrically coupled to the anode power cord through the contact plate 11 and the anode plate 12.

Although the conventional lamp holder has no electric connection issue, yet its manufacturing process is complicated and redundant materials are wasted. In FIG. 1, the lamp holder 1 uses two components including the contact plate 11 and the anode plate 12 for making the anode, and there are many overlapped areas of the contact plate 11 and the anode plate 12 and the overlapped areas are greater than half of the area of the contact plate 11 (and also greater than half of the area of the anode plate 12). Obviously, there is an unnecessary waste. Furthermore, the portion of the cathode of the lamp holder 1 is overlapped with the contact socket 13 through a crescent portion on the cathode plate 14 in order to fix the cathode plate 14 and the contact socket 13 onto the insulating base 10 at the same time. However, such arrangement also incurs a redundant waste of materials and an additional material cost. It results in a high material cost of the conventional lamp holder 1, and a low profit margin for manufacturers.

In FIGS. 1 and 2, after a manufacturer assembles the contact plate 11 and the anode plate 12 to the insulating base 10 in the production process of the lamp holder 1, it is necessary to bend the contact plate 11 by a machine, so that the contact portion 110 is formed on the contact plate 11, and such arrangement incurs a secondary manufacture, not only complicating the production procedure, but also introducing a risk of damaging the lamp holder 1 during the process of bending the contact plate 11 and failing to maintain a high yield rate.

Therefore, it is an important subject of the present invention to improve the structure of the conventional lap holder to achieve the effects of reducing the material cost, simplifying the manufacturing and assembling procedures, and enhancing the production efficiency and yield rate effectively.

SUMMARY OF THE INVENTION

In view of the aforementioned shortcomings of the conventional lamp holder, the inventor of the present invention based on years of experience in the related industry to conduct extensive researches and experiments, and finally developed a lamp holder of the present invention, in hope of achieving the effects of lowering the material cost of the lamp holder, improving the yield rate of the lamp holder, and simplifying the component manufacture and assembling procedure of the lamp holder.

Therefore, it is a primary objective of the present invention to provide a lamp holder comprising an insulating base, a contact plate, a first fixing element, an anode wiring element, a contact socket, a second fixing element and a cathode wiring element, wherein the insulating base includes a first penetrating hole and a second penetrating hole, both formed on and penetrated through the insulating base; an end of the contact plate is substantially in a curved shape, and another end of the contact plate is fixed at a position on a side of the insulating base having the first penetrating hole through an end of the first fixing element, such that a predetermined distance is maintained between an end of the contact plate and the insulating base; the first fixing element is made of an electrically conductive material and passed through the first penetrating hole, and another end of the first fixing element is situated outside another side of the insulating base; the anode wiring element is fixed onto the other side of the insulating base by the other end of the first fixing element and provided for coupling an anode power cord; a first opening and a second opening are formed at top and bottom sides of the contact socket respectively, and a thread is formed on an internal side of the contact socket for securing the bulb onto the contact socket, and an extended portion is extended inwardly towards an edge of the second opening, and the extended portion is fixed at a position on a side of the insulating base having the second penetrating hole through an end of the second fixing element; the second fixing element is made of an electrically conductive material and passed through the second penetrating hole, and the other end of the second fixing element is situated outside the other side of the insulating base; the cathode wiring element is fixed onto the other side of the insulating base by the other end of the second fixing element, and the cathode wiring element is provided for coupling a cathode power cord. When the bulb is secured into the contact socket, the anode of the bulb abuts an end of the contact plate, and the cathode of the bulb contacts with the contact socket, such that the first and second electrodes of the bulb are electrically and respectively coupled to the anode and cathode power cords, and the bulb can obtain electric power to emit light. With the present invention, the contact plate is electrically coupled to the anode wiring element through the first fixing element, and the contact socket is electrically coupled to the cathode wiring element through the second fixing element. The present invention not only simplifies the structure of the lamp holder, but also lowers the material cost of the lamp holder. Manufacturers no longer need to bend the contact plate after the contact plate is assembled onto the insulating base, and thus the invention can simplify the manufacturing procedure to avoid a secondary manufacture.

Another objective of the present invention is to provide a lamp holder, wherein the anode wiring element is comprised of a first metal plate and a first screw, and the first metal plate is substantially in a curved shape, and a position on the first metal plate and proximate to an end of the first metal plate is fixed onto another side of the insulating base by another end of the first fixing element, and a first screw hole is formed at a position on the first metal plate and proximate to the other end of the first metal plate and secured onto the first screw hole, such that the anode power cord is clamped between the first metal plate and the first screw.

A further objective of the present invention is to provide a lamp holder, wherein the cathode wiring element is comprised of a second metal plate and a second screw, and the second metal plate is substantially in a curved shape, and a position on the second metal plate and proximate to an end of the second metal plate is fixed onto the other side of the insulating base by the second fixing element, and a second screw hole is formed at a position on the second metal plate and proximate to an end of the second metal plate and secured onto the second screw hole, such that the cathode power cord is clamped between the second metal plate and the second screw.

DETAILED DESCRIPTION OF THE PREFERRED EMBODIMENTS

Based on the research, development and manufacture of related lamp products conducted by the inventor of the present invention for years, it is found that the conventional lamp holders have the disadvantages of a complicated structure, a high material cost and a complicated manufacturing procedure, and most manufacturers adopt the conventional lamp holder structure for the production without making adjustments or improvements to the overall structure of the lamp holders, and thus the problems of the conventional lamp holders still exist. Therefore, the inventor of the present invention has made adjustments to the overall structure of the lamp holder to achieve the effects of saving material costs and simplifying the production procedure.

Figure 3:
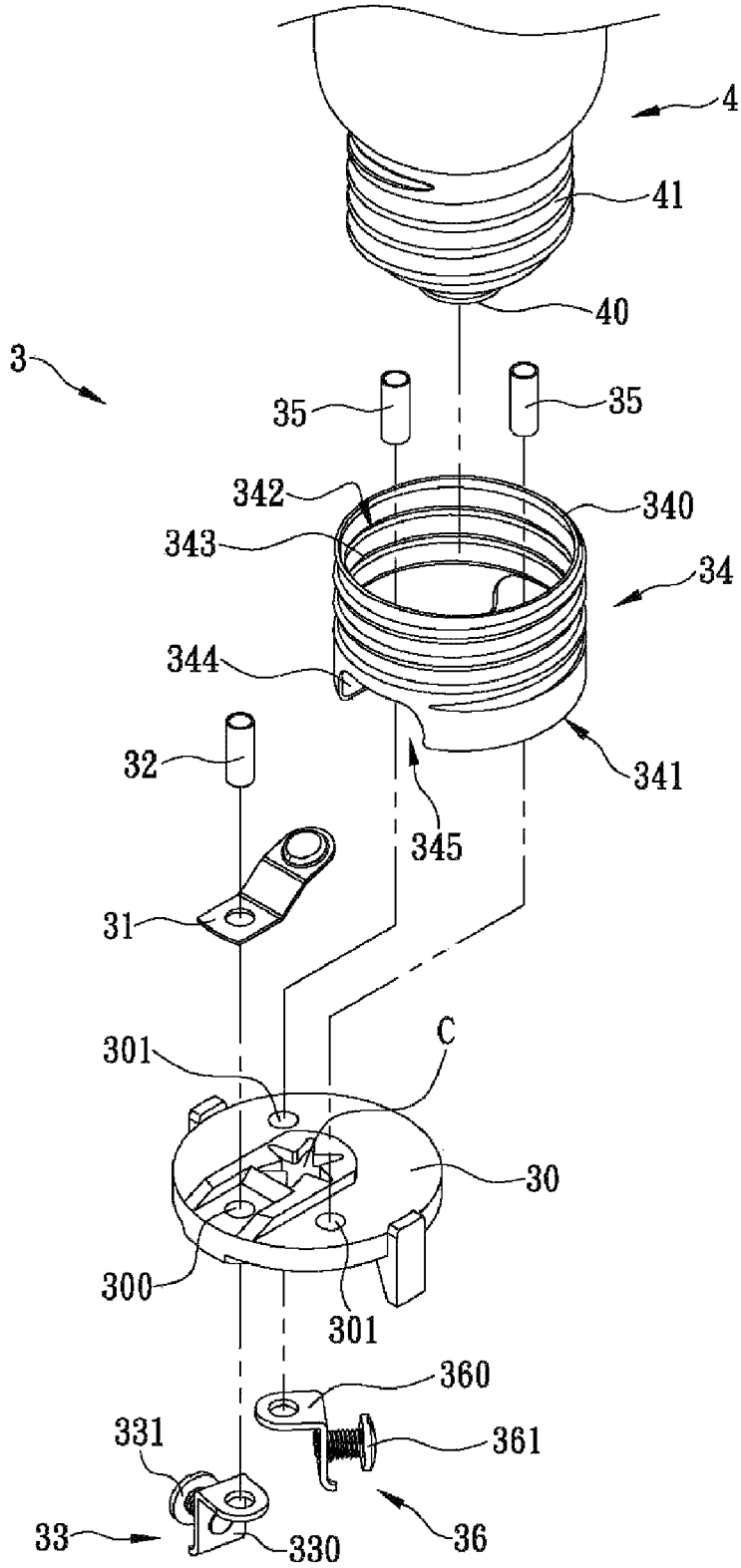
FIG. 3 is an exploded view of a lamp holder of the invention.

With reference to FIG. 3 for a lamp holder for installing a bulb in accordance with a preferred embodiment of the present invention, the lamp holder 3 comprises an insulating base 30, a contact plate 31, a first fixing element 32, an anode wiring element 33, a contact socket 34, two second fixing elements 35 and a cathode wiring element 36, wherein the insulating base is generally made of a plastic material to assure the insulation of the insulating base, and the contact plate 31, the anode wiring element 33 and the contact socket 34 are made of an electrically conductive material (such as a metal), and a first penetrating hole 300 and two second penetrating holes 301 are formed on and penetrated through the insulating base 30, and the first penetrating hole 300 is disposed at a position corresponding to the first fixing element 32, and each second penetrating hole 301 is disposed at a position corresponding to each second fixing element 35. An end of the contact plate 31 (which is the upper right end as shown in FIG. 3) is substantially in a curved shape, and the curved portion is corresponsive to a center position C of the insulating base 30. Another end of the contact plate 31 (which is the upper left end as shown in FIG. 3) is fixed at a position on the top side of the insulating base 30 having the first penetrating hole 300 through an upper end of the first fixing element 32, wherein the first fixing element 32 of this preferred embodiment is a rivet, so that the contact plate 31 is riveted onto the insulating base 30, and a predetermined distance can be maintained between an end (which is the upper right end as shown in FIG. 3) of the contact plate 31 and the insulating base 30 in a vertical direction.

Figure 5:
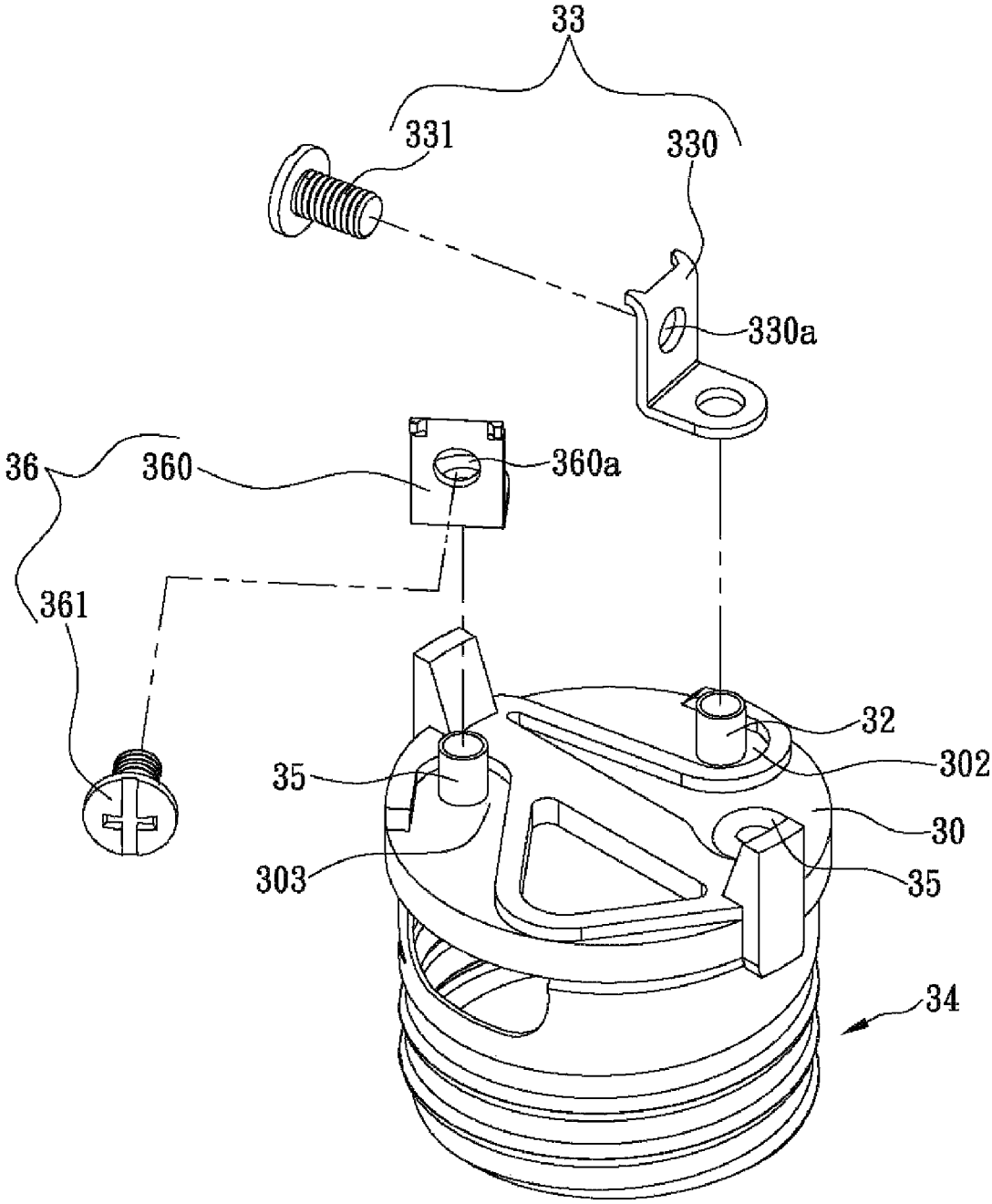
FIG. 5 is another perspective view of a lamp holder of the invention.

In FIG. 3, the first fixing element 32 is made of an electrically conductive material, and manufacturers can adopt a metal material such as bronze for manufacturing the first fixing element 32, and the first fixing element 32 is passed through the first penetrating hole 300, such that a bottom end of the first fixing element 32 is situated outside the bottom side of the insulating base 30. In FIGS. 3 and 5, the anode wiring element 33 is comprised of a first metal plate 330 and a first screw 331, and the first metal plate 330 is substantially in a curved shape, and a position the first metal plate 330 and proximate to an end (which is the right end as shown in FIG. 5) of the first metal plate 330 is fixed onto the other side of the insulating base 30 through the other end of the first fixing element 32, and a first screw hole 330*a* is formed at a position on the first metal plate 330 and proximate to the other end of the first metal plate 330, and the first screw 331 is screwed into the first screw hole 330*a* to clamp an anode power cord (not shown in the figure) between the first metal plate 330 and the first screw 331. To assure that the anode wiring element 33 can be fixed securely onto the insulating base 30, a first groove 302 is concavely formed at a position on the bottom side of the insulating base 30 and proximate to the anode wiring element 33 for accommodating the anode wiring element 33, and preventing the anode wiring element 33 from being turned or loosened, so as to enhance the convenience of the assembling process.

Figure 4:
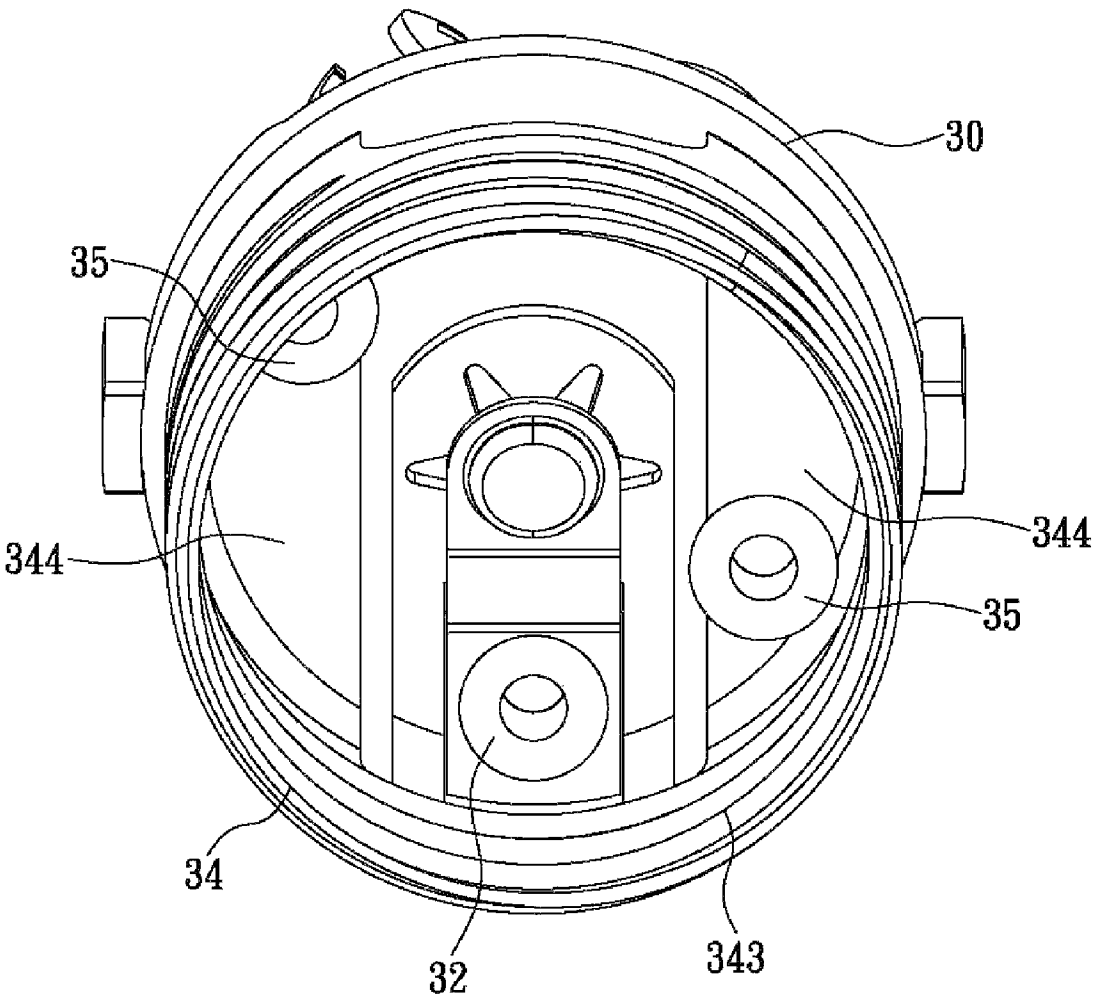
FIG. 4 is a perspective view of a lamp holder of the invention.

In FIG. 3, a first opening 340 and a second opening 341 are formed on both upper and lower sides of the contact socket 34 respectively, and the first and second openings 340, 341 are interconnected with each other, and a containing space 342 is defined in the contact socket 34, and a thread 343 is formed on an internal side of the contact socket 34 and provided for screwing the bulb 4 onto the contact socket 34. In FIGS. 3 and 4, two extended portions 344 are extended radially inward from the bottom side of the contact socket 34 which is an edge of second opening 341, and a notch 345 is formed at an edge of the second opening 341, and the extended portions 344 is fixed at a position on a side of the insulating base 30 having the second penetrating hole 301 through an end of each second fixing element 35. In this preferred embodiment, each second fixing element 35 is a rivet, so that the contact socket 34 is riveted onto the insulating base 30 through the second fixing elements 35. It is noteworthy to point out that the quantity of second fixing elements 35 is limited to two, but manufacturers can increase or decrease the quantity of the second fixing elements 35 according to the design and manufacture of the lamp holder 3 of the invention. Similarly, the quantity of second penetrating holes 301 and extended portions 344 can be changed or adjusted according to the quantity of second fixing elements 35, and the change of quantity is obvious to those ordinarily skilled in the art and should be covered by the scope of the appended claims of the invention.

In FIG. 3, the notch 345 of the contact socket 34 is disposed at a position corresponding to the other end (which is the left end) of the contact plate 31 to prevent the contact socket 34 and the contact plate 31 from being contacted with one another to avoid short circuits. In addition, the second fixing element 35 is made of an electrically conductive material and passed through the second penetrating hole 301, and the bottom end of the second fixing element 35 is situated outside the bottom side of the insulating base 30. In FIGS. 3 and 5, the cathode wiring element 36 is comprised of a second metal plate 360 and a second screw 361, and the second metal plate 360 is substantially in a curved shape, and a position on the second metal plate 360 and proximate to an end of the second metal plate 360 is fixed onto another side of the insulating base 30 through another end of a second fixing element 35, and a second screw hole 360*a* is formed at a position on the second metal plate 360 and proximate to the other end of the second metal plate 360, and the second screw 361 is screwed into the second screw hole 360*a*, such that a cathode power cord (not shown in the figure) can be clamped between the second metal plate 360 and the second screw 361. In addition, a second groove 303 is concavely formed at a position on another side of the insulating base 30 and proximate to the cathode wiring element 36 and provided for installing the cathode wiring element 36 onto the insulating base 30 securely.

Figure 1:
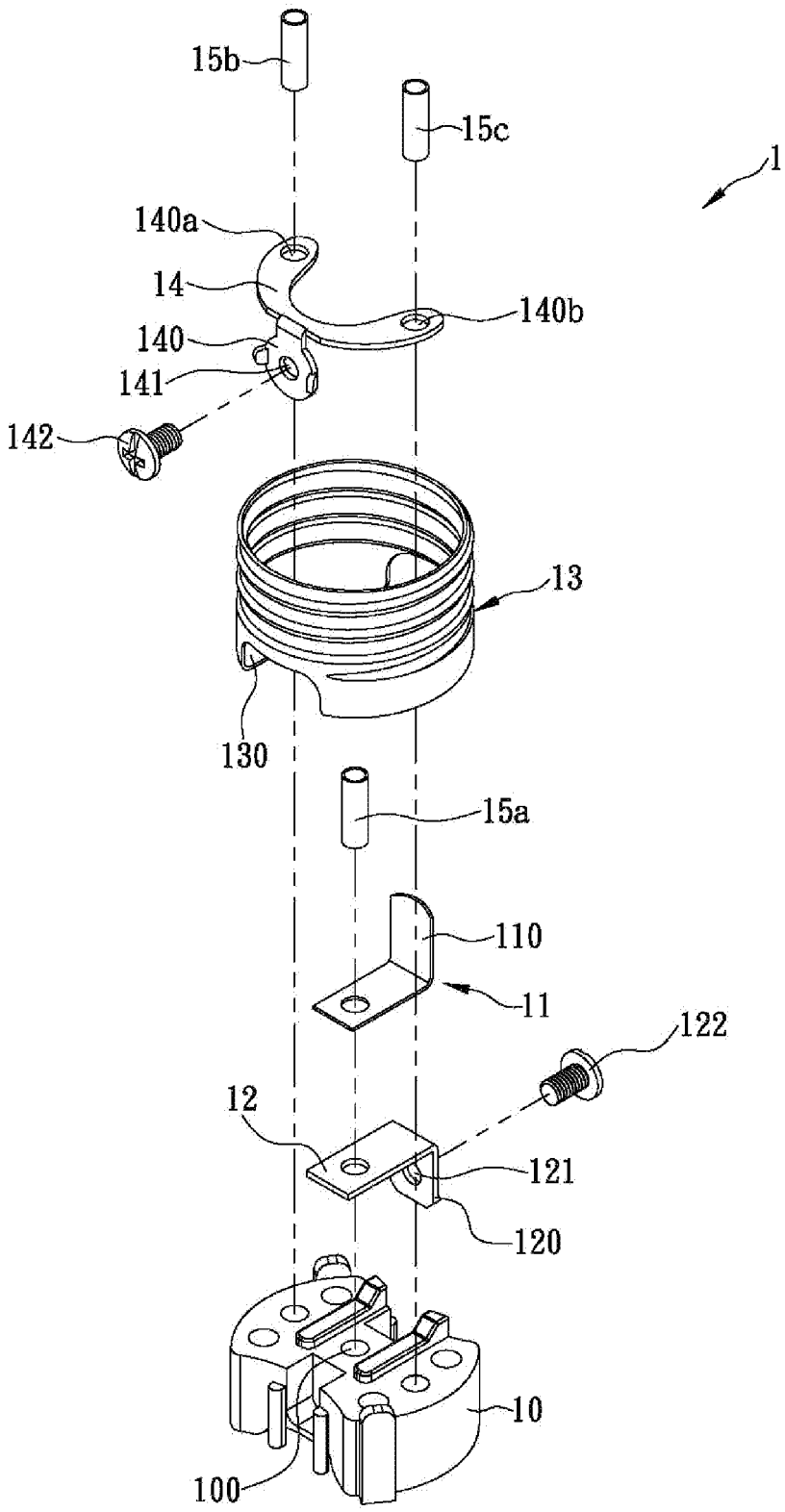
FIG. 1 (Prior Art)
FIG. 1 is a perspective exploded view of a conventional lamp holder.
Figure 2:
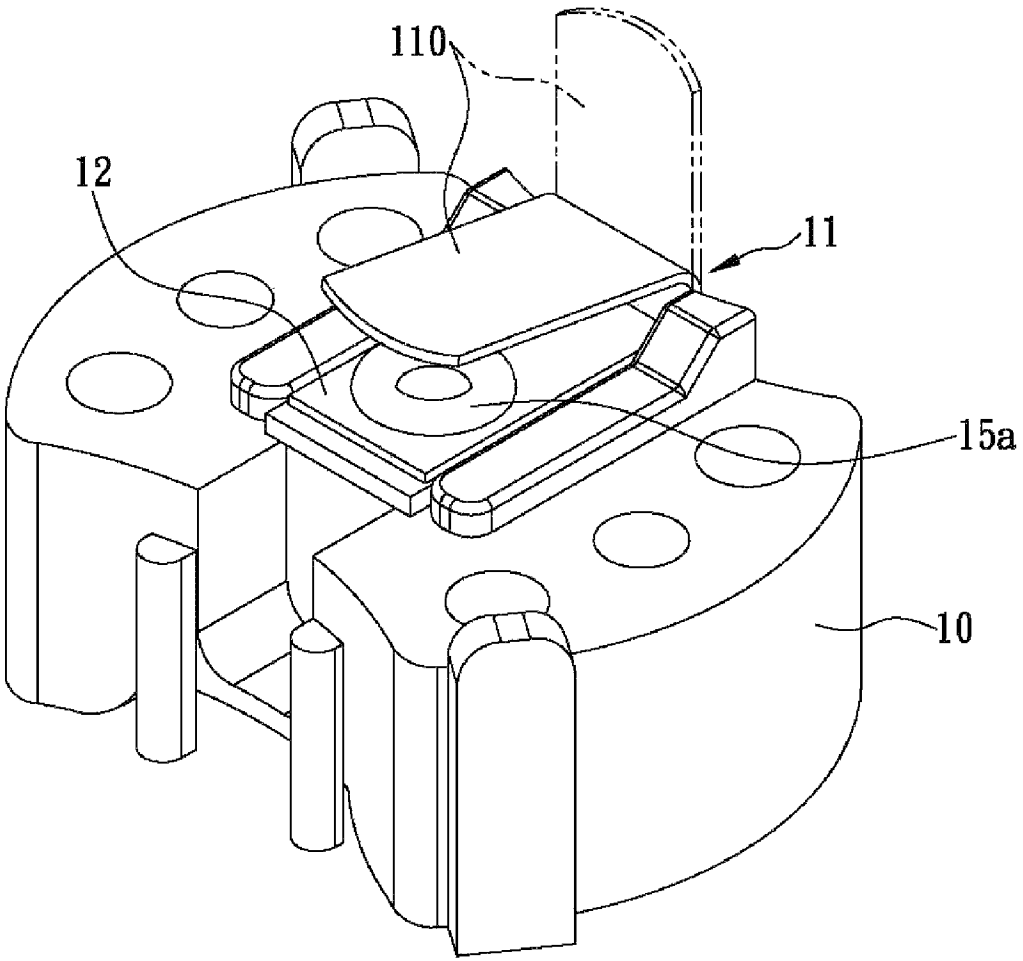
FIG. 2 (Prior Art)
FIG. 2 is an exploded view, showing components of a conventional lamp holder.

In the aforementioned preferred embodiment as shown in FIG. 3, when the bulb 4 is screwed onto the contact socket 34, the first electrode 40 (anode) of the bulb 4 is abutted against an end (which is the upper right end as shown in the figure) of the contact plate 31, and the second electrode 41 (cathode) of the bulb 4 is contacted with the contact socket 34, such that the first and second electrodes 40, 41 of the bulb 4 can be electrically and respectively coupled to the anode and cathode power cords through the anode wiring element 33 and the cathode wiring element 36, and the bulb 4 can obtain electric power to emit light. With the technical characteristics of the foregoing preferred embodiment of the present invention, the contact plate 31 can be electrically and directly coupled to the anode wiring element 33 through the first fixing element 32, and the contact socket 34 can be electrically and directly coupled to the cathode wiring element 36 through the second fixing element 35. Compared with the conventional lamp holder 1 as shown in FIG. 1, the present invention not only simplifies the structure of the lamp holder 3, but also reduces the waste of redundant materials and the material cost of the lamp holder 3 to improve the profit of producing the lamp holder significantly. More importantly, manufacturers no longer require bending the contact plate 31 after the contact plate 31 is assembled onto the insulating base 30, and such technical characteristic not only simplifies the manufacturing procedure, but also avoids possible damages to the contact plate 31 to enhance the yield rate and quality of the product substantially. It is noteworthy to point out that the lamp holder 3 of the present invention comes with a simple structure, so that both volume and weight are smaller than those of the conventional lamp holder 1 (as shown in FIG. 1), and the lamp holder 3 of the present invention further has the advantage of reducing the transportation cost.

While the invention has been described by means of specific embodiments, numerous modifications and variations could be made thereto by those skilled in the art without departing from the scope and spirit of the invention set forth in the claims.

What is claimed is:

1. A lamp holder, comprising:

an insulating base, including a first penetrating hole and a second penetrating hole both formed on and penetrated through the insulating base;

a contact plate, made of an electrically conductive material and having an end substantially in a curved shape;

a first fixing element, made of an electrically conductive material and passed through the first penetrating hole, wherein another end of the contact plate is fixed to a position on a side of the insulating base having the first penetrating hole by an end of the first fixing element, and another end of the first fixing element is disposed outside another side of the insulating base;

an anode wiring element, made of an electrically conductive material and fixed to the other side of the insulating base by the other end of the first fixing element, wherein the anode wiring element is provided for coupling an anode power cord;

a contact socket, made of an electrically conductive material and including a first opening and a second opening formed at top and bottom sides of the contact socket respectively, a thread formed on an internal side of the contact socket and an extended portion extended radially and inwardly from an edge of the second opening;

a second fixing element, made of an electrically conductive material and passed through the second penetrating hole, wherein an end of the second fixing element is provided for fixing the extended portion to a position of a side of the insulating base having the second penetrating hole, and another end of the second fixing element is disposed outside the other side of the insulating base; and a cathode wiring element, made of an electrically conductive material and fixed to the other side of the insulating base by the other end of the second fixing element, wherein the cathode wiring element is provided for coupling a cathode power cord.

2. The lamp holder of claim 1, wherein the second opening further includes a notch formed at an edge of the second opening and disposed corresponding to the other end of the contact plate.

3. The lamp holder of claim 2, wherein the first fixing element and the second fixing element are rivets respectively.

4. The lamp holder of claim 3, wherein the anode wiring element is comprised of a first metal plate and a first screw, and the first metal plate is substantially in a curved shape, and a position of the first metal plate proximate to an end of the first metal plate is fixed to the other side of the insulating base by the other end of the first fixing element, and a first screw hole is formed at a position of the first metal plate proximate to the other end of the first metal plate, and the first screw is screwed into the first screw hole for clamping the anode power cord between the first metal plate and the first screw.

5. The lamp holder of claim 4, wherein the cathode wiring element is comprised of a second metal plate and a second screw, and the second metal plate is substantially in a curved shape, and a position of the second metal plate proximate to an end of the second metal plate is fixed to the other side of the insulating base by the other end of the second fixing element, and a second screw hole is formed at a position of the second metal plate proximate to the other end of the second metal plate and screwed into the second screw hole for clamping the cathode power cord between the second metal plate and the second screw.

6. The lamp holder of claim 5, further comprising a first groove concavely formed at a position of the other side of the insulating base proximate to the anode wiring element and the first groove disposed corresponding to the first metal plate for accommodating the first metal plate.

7. The lamp holder of claim 6, further comprising a second groove concavely formed at a position of the other side of the insulating base and proximate to the cathode wiring element and disposed corresponding to the second metal plate for accommodating the second metal plate.

* * * * *